US005112155A

United States Patent [19]

Jackson

[11] Patent Number: 5,112,155

[45] Date of Patent: May 12, 1992

[54] CONNECTOR FOR ASSEMBLING COMPONENTS OF SCAFFOLDING

[76] Inventor: George W. Jackson, 2570 Drew Rd., Mississauga, Ontario, Canada, L4T 3M5

[21] Appl. No.: 787,426

[22] Filed: Nov. 4, 1991

[51] Int. Cl.[5] ..... E04G 7/00

[52] U.S. Cl. ..... 403/49; 411/345; 411/340

[58] Field of Search ..... 403/49; 411/345, 340

[56] References Cited

U.S. PATENT DOCUMENTS 2,698,552 1/1955 Smith ..... 411/345

FOREIGN PATENT DOCUMENTS 1318295 5/1973 United Kingdom ..... 411/340

*Primary Examiner*—Andrew V. Kundrat

*Attorney, Agent, or Firm*—Jeffrey T. Imai; Arne I. Fors

[57] ABSTRACT

A connector for assembling components of scaffolding is disclosed comprising a barrel having an opposite end having a longitudinally extending slot. A pivot pin and an abutment pin extends across the slot and mounted at the opposite end of the barrel. A free hanging latch has an offset aperture for pivotally mounting onto the pivot pin and a channel for receiving the abutment pin. One end of the channel is configured to abut with the abutment pin when the latch is in a locked position and the other end of the channel being configured to abut the abutment pin when the latch is in an unlocked position. The latch has a tab which is offset beyond the end of the barrel whereby pressing on the tab, the latch pivots from the locked position to the unlocked position allowing egress of the brace from the connector.

4 Claims, 4 Drawing Sheets

FIG.1. PRIOR ART.
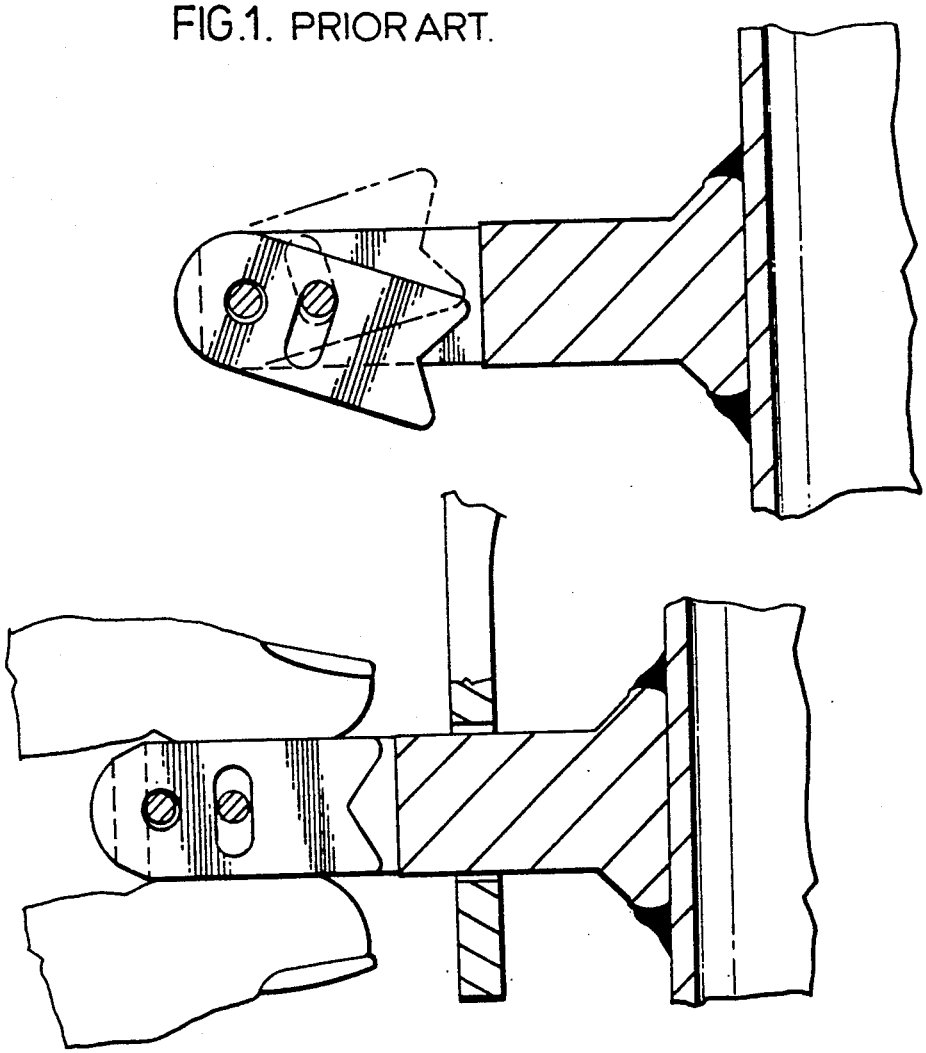
FIG.2. PRIOR ART.
FIG.12.
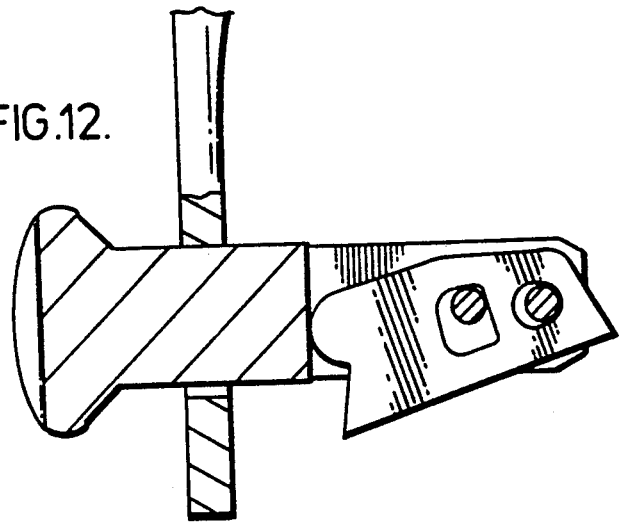

FIG. 3.
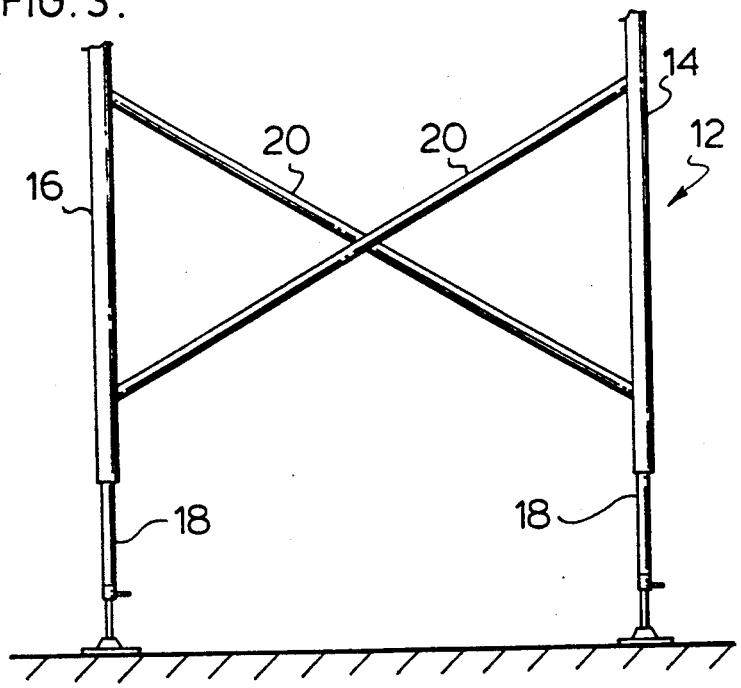
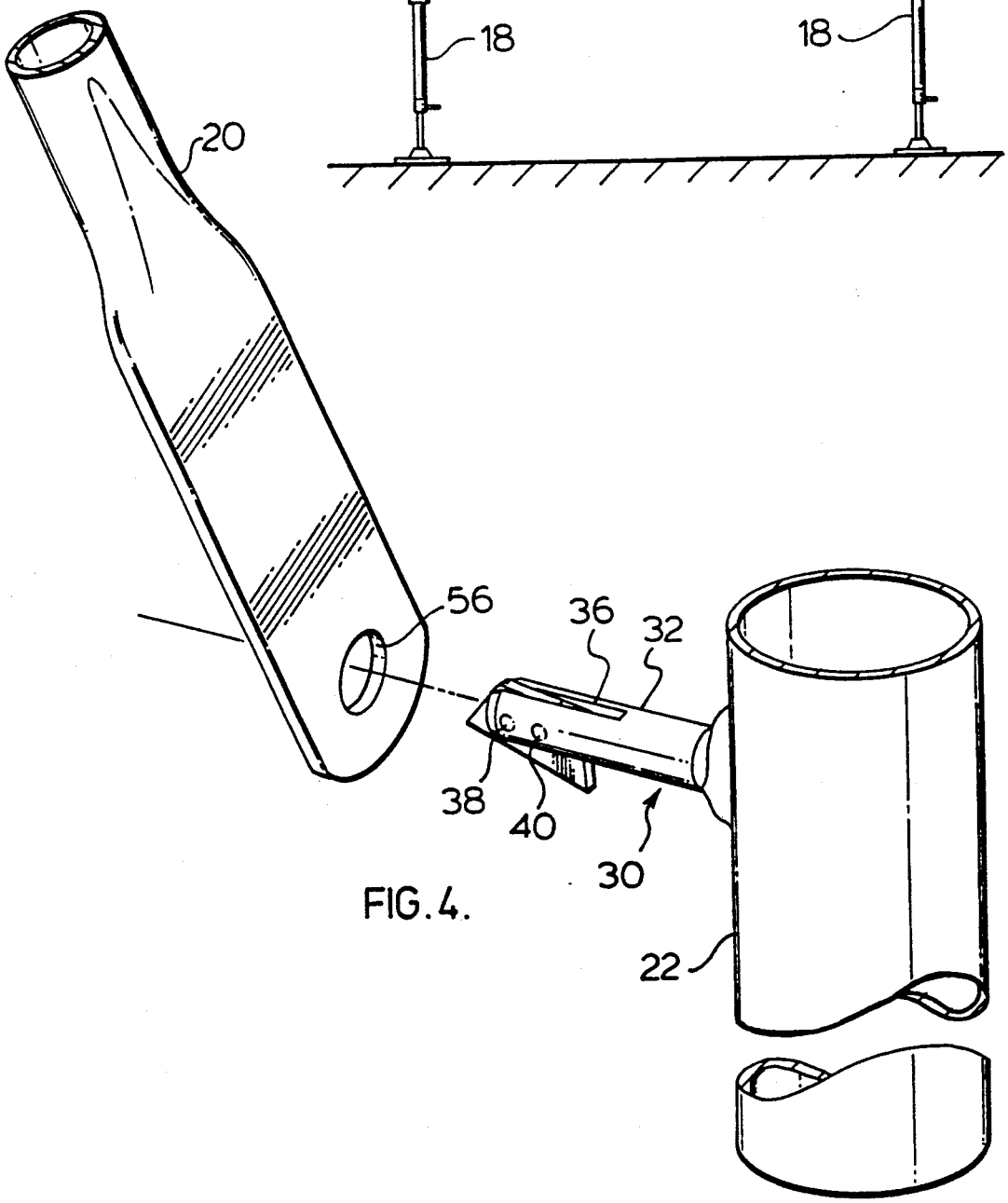
FIG. 4.

CONNECTOR FOR ASSEMBLING COMPONENTS OF SCAFFOLDING

FIELD OF INVENTION

This invention relates to a connector for interlocking components of scaffolding or form structures used in construction.

BACKGROUND OF INVENTION

Scaffolding is commonly used in the construction industry for supporting workers above the ground and for use as a shoring tower or structure. Scaffolding comes in many configurations but generally is available in end frame pieces which are releasably connected by braces or cross braces. Connectors or brace locks are necessary to connect or interlock the braces to the end frames to form a substantially rigid structure. Quick assembly or dismantling is an important feature in scaffolding as the scaffolding is repeatedly assembled and dismantled.

Several types of connectors are commercially available. One such connector is described in U.S. Pat. No. 4,470,574. This connector consists of a barrel having a depressible latch swingably mounted therein and normally projecting outwardly. The latch has a handle projecting from the outer end of the barrel and is spring loaded whereby the latch can swing inwardly into the barrel. The cross-braces have an aperture through their ends which can fit over the barrel. The cross brace end is slipped over and along the barrel whereby the latch swings inwardly allowing the barrel to fully mate with the cross brace end. The latch swings outwardly to prevent the cross brace from being removed from the barrel. To remove the brace, the latch is depressed, swinging the latch into the barrel allowing the brace to be removed from the barrel.

This connector generally has been satisfactory. However in prolonged use, the springs wear out losing their effectiveness. Further, the springs occasionally break causing inconvenience and costs in repair and replacement of the broken springs.

Still other types of connectors are commercially available. FIGS. 1 and 2 illustrates a common prior art connector. This connector comprises a barrel having a slot in the end thereof. A latch is pivotally mounted within the slot and is offset. When the barrel is in a horizontal orientation, the latch pivots downwardly. The brace is presented to the barrel and inserted therethrough. The latch pivots upwardly allowing the brace to pass and then pivots downwardly by force of gravity preventing the brace from being removed. To remove the brace the latch is pivoted upwardly until it is fully within the slot and aligned with the barrel allowing the brace to be removed.

In use, this type of connector is difficult to align the latch fully within the barrel to remove the brace. These connectors are designed to operate either right side up or upside down, allowing the end frame to be installed in either orientation. The latch is therefore configured to pivot in either direction When the worker presses the latch upwardly, the latch is able to pass through the slot and extend upwardly preventing the brace from being removed. Quite often the worker dismantling a tower is wearing gloves which reduces the dexterity of the worker making it very difficult to remove the brace. Further, the worker is normally removing the upper frames of a tower and is therefore required to hang onto the frame with one hand allowing only one hand to remove the brace. The difficulties in removing the braces are amplified in these circumstances creating an unnecessary safety risk.

The disadvantages of the prior art may be overcome by providing a connector which has a latch which can secure a brace for assembling a rigid tower and which can be easily and quickly aligned with the barrel to permit the removal of the brace.

According to one aspect of the invention there is provided a barrel having one end adapted to be mounted onto a frame and an opposite end having a longitudinally extending slot. A pivot pin and an abutment pin extends across the slot and mounted at the opposite end of the barrel. A free hanging latch, having an offset aperture for pivotally mounting onto the pivot pin and a channel for receiving the abutment pin, pivots between a locked position wherein one end thereof hangs beyond the diameter of the barrel to prevent egress of a connected brace and an unlocked position wherein the latch substantially aligns with the barrel. The improvement comprises one end of the channel being configured to abut with the abutment pin when the latch is in the locked position and the other end of the channel being configured to abut the abutment pin when the latch is in the unlocked position and the latch has a tab which is offset beyond the end of the barrel whereby pressing on the tab, the latch pivots from the locked position to the unlocked position allowing egress of the brace from the connector. The assembly or dismantling of brace and frame may be accomplished with one hand.

DETAILED DESCRIPTION OF THE DRAWINGS

In drawings which illustrate embodiments of the invention,

FIG. 1 is a partial sectional elevation view of a prior art connector,

FIG. 2 is a partial sectional elevation view of the prior art connector of FIG. 1 with a brace installed;

FIG. 3 is a partial elevation view of a scaffolding employing the present invention;

FIG. 4 is a perspective view of the present invention having a brace being assembled;

FIG. 12 is a side sectional view of an alternate embodiment of the latch of the present invention.

DETAILED DESCRIPTION OF THE INVENTION

Figure 5:
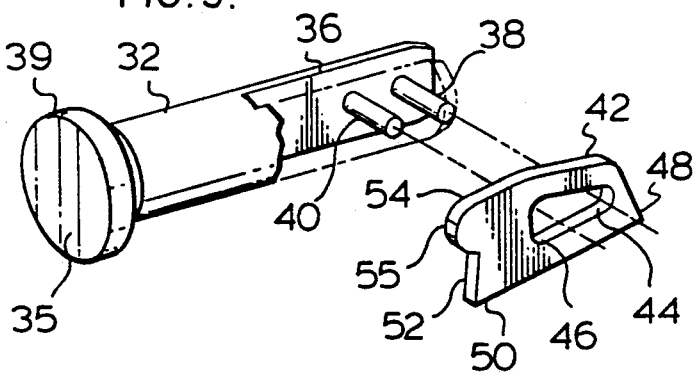
FIG. 5 is a perspective view of the embodiment of FIG. 4, partially in section and broken away.
Figure 5:
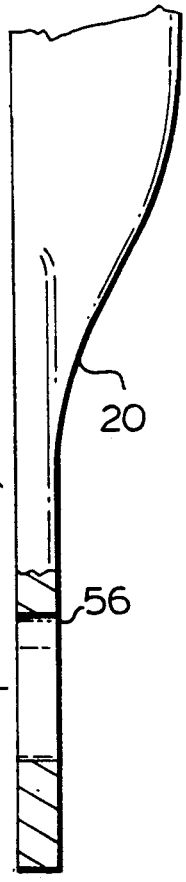

With reference to FIG. 3 of the drawings, support structure 12 comprises end frames 14 and 16 and is supported on feet 18. Extending between end frames 14 and are braces 20. The braces are connected to the end frames to form a rigid structure.

Frames 14 and 16 comprise a pair of laterally spaced legs 22. These legs are usually tubular. The legs are spaced apart and interconnected by suitable bracing or horizontal ledgers extending therebetween and secured thereto at opposite ends in any suitable manner, such as welding. The number of ledgers will depend on the height of the frames. The ledgers not only act as braces for the end frames, but planks or the like may be laid thereon to act as a platform for workers.

Frames 14 and 16 are releasably connected therebetween by braces 20. At the upper and lower end regions of legs 22, connectors 30 generally extend inwardly towards the opposite leg of the frame.

With reference to FIGS. 4 and 5, connector 30 is illustrated in greater detail. Connector 30 has a barrel 32 having a flange 39 at one end. Flange 39 has an arcuate surface 35, preferable having a radius equivalent to the outside radius of legs 22. The opposite end of barrel 32 has a longitudinally extending slot 36 extending over a length of the barrel. Pivot pin 38 and abutment pin 40 extend across slot 36 at the opposite end of the barrel.

With reference to FIG. 5, latch 42 is illustrated. Latch 42 generally has a length greater than a height greater than a depth. The length and depth of latch is substantially the same length and width of slot 36 but adapted to freely pass within slot 36. The height of latch 42 is uniform and substantially the same as the diameter of barrel 32. Latch 42 has at one end thereof an offset pivot aperture 44 and a channel 46 extending transversely. Aperture 44 is offset to one end of the latch 42 but is substantially mid-height thereof. In the preferred embodiment, aperture 44 and channel 46 are illustrated as an integral aperture. However, it is apparent that two separate apertures could be used as illustrated in FIG. 12.

Figure 6:
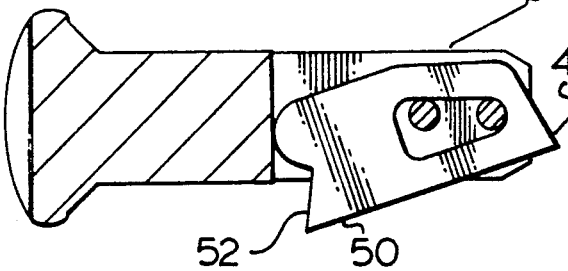
FIG. 6 is a side sectional view of the embodiment of FIG. 4 with a brace being presented to the connector.
Figure 7:
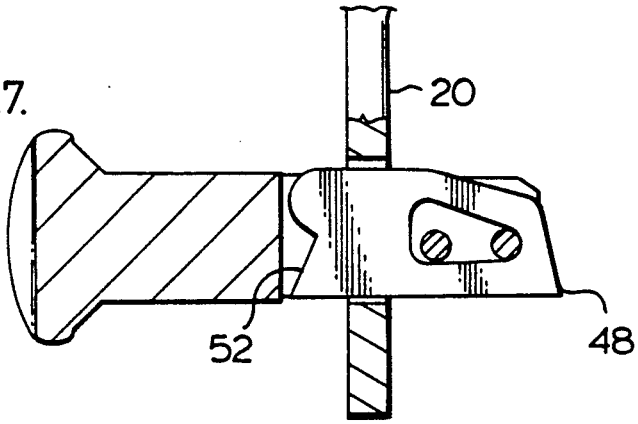
FIG. 7 is a side sectional view of the embodiment of FIG. 4 with a brace being passed onto the connector.
Figure 8:
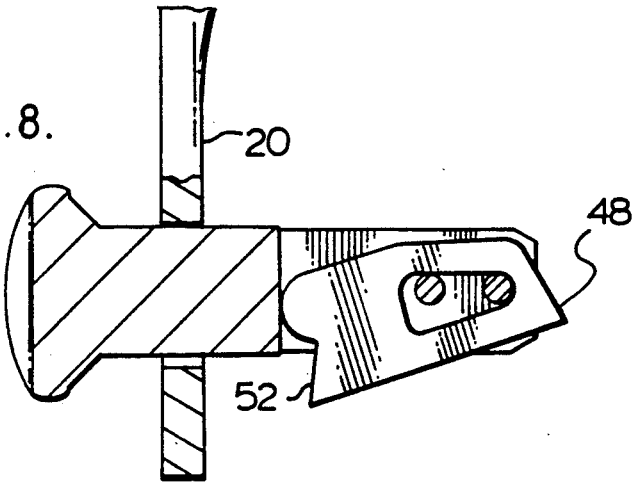
FIG. 8 is a side sectional view of the embodiment of FIG. 4 with a brace fully secured onto the connector.

The lower tangential edge of aperture 44 and the lower end of channel 46 are substantially parallel with lower edge 50 of latch 42. The upper end of channel 46 is spaced closer to the upper edge 54 of latch 42 than aperture 44. As illustrated in FIGS. 6 and 7, latch 42 freely hangs on pivot pin 38 for pivotal movement thereabout. The limit of the pivot is defined by the ends of channel 46.

Latch 42 has a tab 48 at one end thereof which extends longitudinally and slopes downwardly and outwardly. The opposite end of latch 42 is configured to have a first surface 52 extending at an acute angle to lower edge 50 of the latch and extending approximately half the height of the latch. Protrusion 55 above first surface 52 acts as weight to increase the pivot action of the latch due to gravity.

To manufacture a connector 30 of the present invention, round bar stock of either aluminum or steel is cut to the desired length. One end of the stock is forged to form flange 39. A pair of spaced holes are bored transversely of the stock. Slot 36 is cut perpendicular to the holes.

Latch 42 is punched from a sheet of metal, either aluminum or steel. Pivot aperture 44 and channel 46 are sized to receive pivot pin 38 and abutment pin 40, respectively. Channel 46 is spaced from aperture 44 the same distance as pivot pin 38 is spaced form abutment pin 40. The latch is inserted into slot 36 with tab 48 extending beyond the end of barrel 32 with the apertures aligning with the spaced holes of barrel 32. Standard spring or roll pins 38 and 40 are inserted through the spaced holes. The ends of pins 38 and 40 lie flush with the outer surface of the barrel 32. The ends are welded to barrel 32 and smoothed forming an integral unit. Alternatively, rivets or other suitable means could be used in place of pins 38 and 40.

Figure 9:
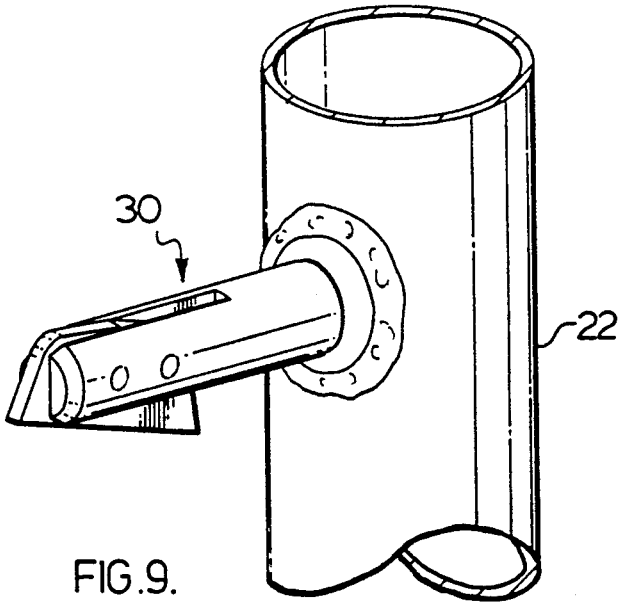
FIG. 9 is a perspective view of the embodiment of FIG. 4 welded to the frame of a scaffold.

The flange 39 of the connector is presented to leg of frames 14 or 16. Flange 39 is welded to the frame around the circumference of flange 39 forming an integral unit as illustrated in FIG. 9.

Figure 10:
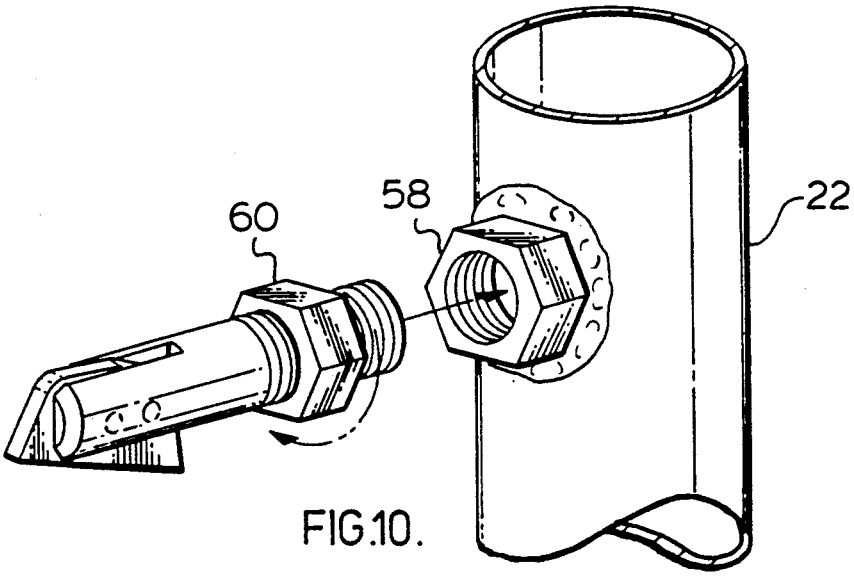
FIG. 10 is a perspective view of a second embodiment of the present invention having an external thread and bolted to the frame leg of a scaffold.
Figure 11:
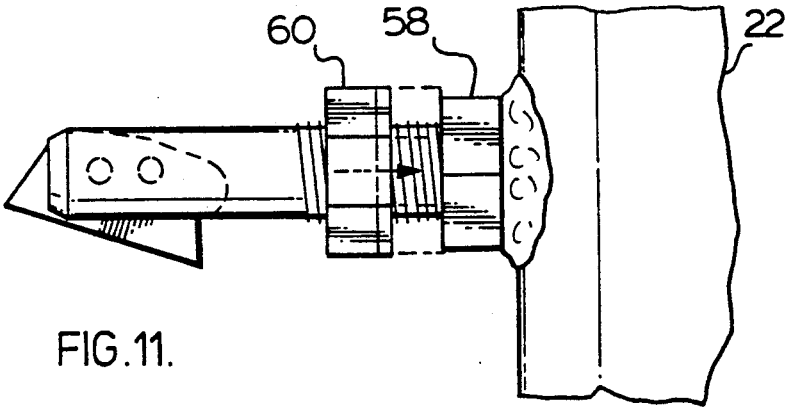
FIG. 11 is a side elevational view of the embodiment of FIG. 10.

Alternatively, the end of the barrel 32 could be threaded as illustrated in FIGS. 10 and 11. A nut 58 is welded onto the frame leg. A locking nut 60 is threaded onto barrel 32 and the unit screwed onto the frame with the locking nut locking the connector to the frame.

This alternative has the advantage that the connector can be inverted if the frame is installed upside down. As is apparent, connector 30 of the present invention can operate only in one orientation. Therefore if the scaffolding were assembled with one frame upside down, the connectors could be inverted without inverting the frame.

The connector 30 normally extends inwardly from the inside surface of each leg. A number of connectors may be installed and spaced along the height of the leg.

In operation, latch 42 hangs downwardly in a locked position with edge 50 extending downwardly as illustrated in FIG. 6. Protrusion 55 provides additional weight to the latch. Brace 20 having an aperture 56 in the end thereof is presented to barrel 32. Barrel 32 extends through aperture 56 as brace 20 travels therealong. The latch will pivot as edge 50 passes aperture 56 of brace 20 and return to its locked position after brace 20 passes completely therethrough. Surface 52 of latch 42 presents an abutment preventing brace 20 from sliding off barrel 32 of the connector.

To remove brace 20, tab 48 is pressed downwardly causing latch 42 to pivot upwardly into an unlocked position. The latch fully rests within slot 36 allowing brace 20 to be freely removed from barrel 32. As is apparent, a worker may remove brace 20 using one hand by gripping brace 20 and using a thumb to depress tab 48. The worker may wear gloves and still be able to depress tab 48 to remove brace 20 safely and easily.

Although the disclosure describes and illustrates the preferred embodiments of the invention, it is understood that the invention is not limited to these particular embodiments or uses. Many variations and modifications will now occur to those skilled in the art. For definition of the invention, reference is made to the appended claims.

I claim:

1. A connector for use in interlocking a brace to a frame, said connector comprising a barrel having one end adapted to be mounted onto a frame and an opposite end having a longitudinally extending slot, a pivot pin and an abutment pin extending across the slot and mounted at the opposite end of the barrel, a free hanging latch having an offset aperture for pivotally mounting onto the pivot pin and a channel for receiving the abutment pin, the latch pivots between a locked position wherein one end thereof hangs beyond the diameter of the barrel in the locked position to prevent egress of a connected brace and an unlocked position wherein the latch substantially aligns with the barrel, wherein the improvement comprises one end of the channel being configured to abut with the abutment pin when the latch is in the locked position and the other end of the channel being configured to abut the abutment pin when the latch is in the unlocked position and the latch has a tab which is offset beyond the end of the barrel whereby pressing on the tab, the latch pivots from the locked position to the unlocked position.

2. A connector as claimed in claim 1 wherein the channel and aperture of said latch is integral with each other.

3. A connector as claimed in claim 2 wherein said one end of the barrel has a flange having an arcuate surface for presenting to a leg of the frame for welding thereto.

4. A connector as claimed in claim 2 wherein said one end of said barrel is threaded for presenting to a nut on leg of said frame for threadingly engaging thereto.

* * * * *